US007941955B2

(12) United States Patent
Stone

(10) Patent No.: US 7,941,955 B2
(45) Date of Patent: May 17, 2011

(54) PIVOTING, NON-DETACHABLE MAGAZINE

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 295 days.

(21) Appl. No.: 12/200,151

(22) Filed: Aug. 28, 2008

(65) Prior Publication Data

US 2010/0281731 A1 Nov. 11, 2010

Related U.S. Application Data

(60) Provisional application No. 60/969,035, filed on Aug. 30, 2007.

(51) Int. Cl.
*F41A 9/66* (2006.01)

(52) U.S. Cl. ..... 42/50

(58) Field of Classification Search ..... 42/50, 49.01, 42/49.02, 33.1, 18, 21, 22, 33
See application file for complete search history.

(56) References Cited

U.S. PATENT DOCUMENTS

| | | | | |
|---|---|---|---|---|
| 490,029 | A * | 1/1893 | Mauser | 42/50 |
| 551,572 | A | 12/1895 | Bennett | |
| 667,856 | A * | 2/1901 | Wagner | 42/50 |
| 747,777 | A | 12/1903 | Ross | |
| 954,904 | A | 4/1910 | White | |
| 1,033,408 | A | 7/1912 | Johnson | |
| 1,037,107 | A | 8/1912 | Bennett | |
| 1,039,182 | A | 9/1912 | Parsons et al. | |
| 1,246,984 | A | 11/1917 | Nelson | |
| 1,290,845 | A | 1/1919 | Redfield | |
| 1,401,152 | A * | 12/1921 | Green | 42/18 |
| 1,449,650 | A | 3/1923 | Burton et al. | |
| 1,464,864 | A | 8/1923 | Browning | |
| 1,496,337 | A | 6/1924 | Feederle | |
| 1,702,984 | A | 2/1929 | Shelman | |
| 2,026,252 | A | 12/1935 | Russell et al. | |
| 2,325,484 | A * | 7/1943 | Kucher et al. | 42/18 |
| 2,402,086 | A | 6/1946 | Rix | |
| 2,515,809 | A | 7/1950 | Sunden | |
| 2,594,237 | A | 4/1952 | Wallenhurst | |

(Continued)

FOREIGN PATENT DOCUMENTS

AT 277814 1/1970

(Continued)

OTHER PUBLICATIONS

International Search Report and Written Opinion for PCT/US08/074610 (Issued Mar. 2, 2009).

(Continued)

*Primary Examiner* — Bret Hayes
*Assistant Examiner* — Reginald Tillman, Jr.
(74) *Attorney, Agent, or Firm* — McGuirewoods LLP

(57) ABSTRACT

An improved firearm including a non-detachable, pivoting magazine is disclosed. The magazine is pivotally attached at its rear end to a sliding arm. The sliding arm is slidably retained within the magazine well of the firearm. The sliding arm is configured to move upwardly and downwardly within the track to allow the magazine to be raised into and lowered out of the magazine well. When the magazine is lowered out of the magazine well, the magazine can be pivoted about its pivotal connection with the sliding arm such that a front end portion of the magazine pivots downwardly and rearwardly to allow ammunition cartridges to be loaded into and unloaded from the magazine.

25 Claims, 5 Drawing Sheets

U.S. PATENT DOCUMENTS

| | | | | |
|---|---|---|---|---|
| 2,632,272 | A | | 3/1953 | Holek |
| 2,642,688 | A | * | 6/1953 | Johnson, Jr. ..... 42/50 |
| 2,710,476 | A | | 6/1955 | Garand |
| 2,745,203 | A | | 5/1956 | Ruple |
| 2,828,568 | A | | 4/1958 | Sakewitz |
| 2,910,795 | A | | 11/1959 | Agren |
| 2,931,120 | A | | 4/1960 | Kolinko |
| 2,997,803 | A | | 8/1961 | Florence |
| 3,094,803 | A | | 6/1963 | Green |
| 3,371,440 | A | | 3/1968 | Cassell |
| 3,390,476 | A | * | 7/1968 | Vervier ..... 42/50 |
| 3,574,264 | A | | 4/1971 | Simmons, Sr. |
| 3,623,256 | A | | 11/1971 | Shiplee |
| 3,698,115 | A | | 10/1972 | Henning |
| 3,732,643 | A | | 5/1973 | Wells |
| 3,745,687 | A | | 7/1973 | Koon, Jr. |
| 3,771,415 | A | | 11/1973 | Into et al. |
| 3,883,976 | A | | 5/1975 | Norman et al. |
| 3,905,142 | A | | 9/1975 | Haskell |
| 3,913,251 | A | | 10/1975 | Browning |
| 3,964,199 | A | | 6/1976 | Musgrave |
| 4,087,930 | A | | 5/1978 | Grehl |
| 4,152,857 | A | | 5/1979 | Ketterer |
| 4,213,262 | A | | 7/1980 | Badali |
| 4,237,638 | A | | 12/1980 | Trexler |
| 4,265,043 | A | | 5/1981 | Rowlands |
| 4,310,982 | A | | 1/1982 | Kast et al. |
| 4,356,653 | A | | 11/1982 | Swieskowski |
| 4,360,985 | A | | 11/1982 | Pitzen |
| 4,397,108 | A | | 8/1983 | Musgrave |
| 4,450,641 | A | | 5/1984 | Bullis et al. |
| 4,484,403 | A | | 11/1984 | Schwaller |
| 4,502,237 | A | | 3/1985 | Krogh |
| 4,589,218 | A | | 5/1986 | Teppa |
| 4,615,134 | A | | 10/1986 | Beretta |
| 4,625,621 | A | | 12/1986 | Warin |
| 4,654,993 | A | | 4/1987 | Atchisson |
| 4,736,540 | A | | 4/1988 | Holmes |
| 4,765,081 | A | | 8/1988 | Dieringer |
| 4,888,899 | A | | 12/1989 | Chesnut et al. |
| 5,056,252 | A | | 10/1991 | Velezis |
| 5,099,595 | A | | 3/1992 | Chesnut et al. |
| 5,309,660 | A | | 5/1994 | Blackamore |
| 5,345,660 | A | | 9/1994 | Howard |
| 5,416,998 | A | | 5/1995 | Martel |
| 5,442,874 | A | | 8/1995 | Findlay |
| 5,452,534 | A | | 9/1995 | Lambie |
| 5,507,110 | A | | 4/1996 | Chesnut et al. |
| 5,561,933 | A | | 10/1996 | Czekalski |
| 5,651,204 | A | | 7/1997 | Hulsey et al. |
| 5,664,355 | A | | 9/1997 | Ronkainen |
| 5,685,101 | A | * | 11/1997 | Ferretti ..... 42/18 |
| 5,806,224 | A | | 9/1998 | Hager |
| 5,845,426 | A | | 12/1998 | Valorose |
| 5,854,440 | A | | 12/1998 | Canaday et al. |
| 5,899,013 | A | | 5/1999 | Hauser et al. |
| 6,014,923 | A | | 1/2000 | Canaday et al. |
| 6,070,352 | A | | 6/2000 | Daigle |
| 7,047,685 | B2 | | 5/2006 | Diaz et al. |

FOREIGN PATENT DOCUMENTS

| | | | |
|---|---|---|---|
| AT | 161324 | | 1/1998 |
| AU | 9472662 | | 2/1995 |
| BE | 503724 | | 6/1951 |
| BE | 670534 | | 2/1966 |
| CA | 2167202-AA | | 1/1995 |
| DE | 27665 | | 6/1884 |
| DE | 130805 | | 5/1900 |
| DE | 120862 | | 5/1901 |
| DE | 69407416 | T2 | 6/1998 |
| EP | 708908 | B1 | 12/1997 |
| ES | 2110769 | | 2/1998 |
| FR | 360 165 | | 4/1906 |
| FR | 974 865 | | 2/1951 |
| FR | 1 021 314 | | 2/1953 |
| FR | 1 072 364 | | 9/1954 |
| FR | 939 070 | A | 7/1993 |
| FR | 2 707 747 | | 9/1995 |
| FR | 2 717 892 | | 9/1995 |
| GB | 601582 | | 5/1948 |
| GB | 1144368 | | 3/1969 |
| GR | 3026022 | | 4/1998 |
| PL | 174224 | | 6/1998 |
| WO | WO-95/02799 | | 1/1995 |
| WO | WO-01/59387 | | 8/2001 |
| WO | WO-2009/032742 | | 3/2009 |

OTHER PUBLICATIONS

Taylor, J.M., 21st Century Shotguns: Benelli Nova, "American Hunter" (Jul. 1999).

* cited by examiner

PIVOTING, NON-DETACHABLE MAGAZINE

CROSS-REFERENCE TO RELATED APPLICATIONS

This application claims the benefit of provisional Application No. 60/969,035, filed Aug. 30, 2007, the entire disclosure of which is incorporated herein by reference.

BACKGROUND OF THE INVENTION

Long-barreled firearms often include a cartridge magazine that engages a magazine well situated beneath the bolt assembly of the firearm. In many of these firearms, the magazine can be inserted into or extracted from the magazine well by movement of the magazine in linear translation through the open bottom of the magazine well.

In other firearms, the magazine remains attached to the firearm during loading and unloading procedures. In such firearms, the magazine may pivot to an open position to allow ammunition cartridges to be loaded from the magazine. Such firearms provide added safety and security by ensuring that the magazine does not become separated from the firearm. However, the loading of such magazines can be somewhat difficult due to small clearances and awkward loading angles for inserting the cartridges into the magazine.

In view of the above, it is desirable to provide a firearm including an improved loading system that addresses the foregoing and other related and unrelated problems in the art.

SUMMARY OF THE INVENTION

Briefly described, the present application concerns a firearm including an improved ammunition magazine assembly. A magazine of the ammunition magazine assembly is configured to slide vertically into and out of the magazine well of the firearm, and to pivot with respect to the firearm.

According to an embodiment, the ammunition magazine assembly comprises an arm member configured to be slidably attached within a magazine well of a firearm and a magazine connected to the arm member. The magazine includes a front end portion configured to be received within the magazine well at a front area of the magazine well, and a rear end portion configured to be received within the magazine well at a rear area of the magazine well. The magazine is pivotally connected to the arm member at the rear end portion of the magazine.

A firearm generally can comprise a receiver, with an ammunition magazine receivable in the receiver. The magazine comprises a front end portion configured to be received within the magazine well at a front area of the magazine well, and a rear end portion configured to be received within the magazine well at a rear area of the magazine well. An arm member is slidably mounted on the firearm, and the magazine is pivotally connected to the arm member at the rear end portion of the magazine such that the front end portion of the magazine is pivotable upwardly and downwardly. The arm member is vertically slidable between two positions, including an uppermost position in which the magazine is upwardly pivotable into an operational position, secured within the magazine well, and a lowermost position in which the magazine is downwardly pivotable into a loading and unloading position for loading and unloading ammunition.

Other features and advantages of the invention will be apparent from the following description and drawings.

BRIEF DESCRIPTION OF THE DRAWINGS

The attached drawings show components of a firearm according to an embodiment including a pivoting, non-detachable ammunition magazine.

DETAILED DESCRIPTION OF THE INVENTION

Figure 1:
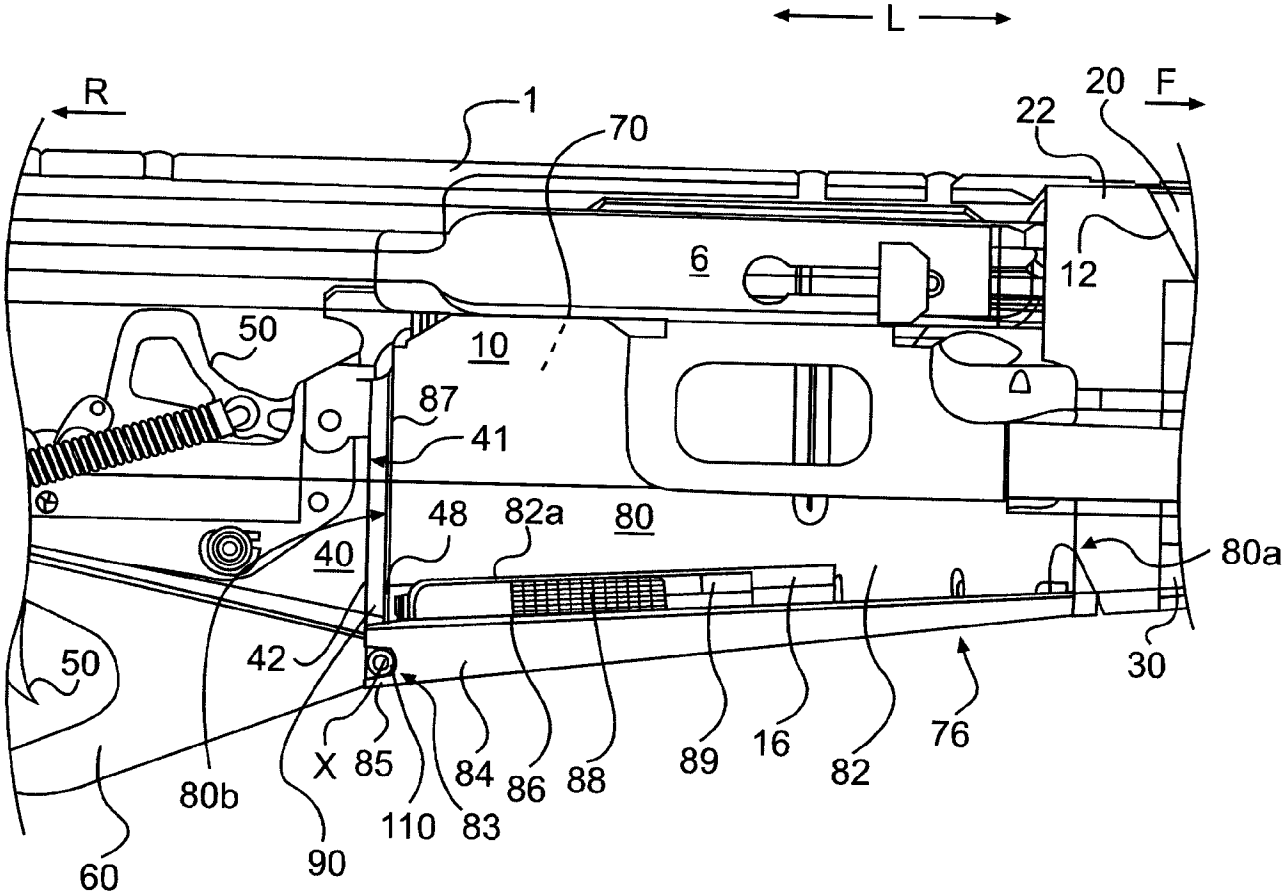
FIG. 1 is a partial side view of showing the firearm with the magazine in an operating position, in which the magazine is engaged within the magazine well of the firearm.

In the present application, the terms "front", "rear", "up", "down", "longitudinal", "horizontal" and "vertical", and any variations thereof, refer to directions with respect to a user of the firearm holding the firearm in the firing position towards a down-range target, except where the text herein clearly specifies that some other meaning is to be given to such terms.

FIGS. 1-4 show a firearm 1 according to an embodiment of the invention. Arrows F and R in FIGS. 1-4 indicate the front and rear directions, respectively, of the firearm. The firearm 1 generally can include a breech casing or receiver 10 disposed between a barrel 20 and a butt stock (not shown) of the firearm 1, with a forestock 30 located beneath the barrel 20. The front end 12 of the receiver 10 cooperates with a rear end 22 of the barrel 20 and a rear end 32 of the forestock 30, while the rear end of the receiver 10 (not shown) cooperates with a front end of the butt stock (not shown). The firearm further includes a trigger housing 60 mounted to the receiver 10. The trigger housing 60 includes a fire control or trigger assembly 40 disposed within the receiver 10, and having a trigger 50 for firing the firearm 1.

It also will be understood by those skilled in the art that while the present invention has been illustrated in the present embodiment as being used in a rifle, the principles of the present application can be applied equally to other firearms, including shotguns and other long guns and handguns.

Figure 2:
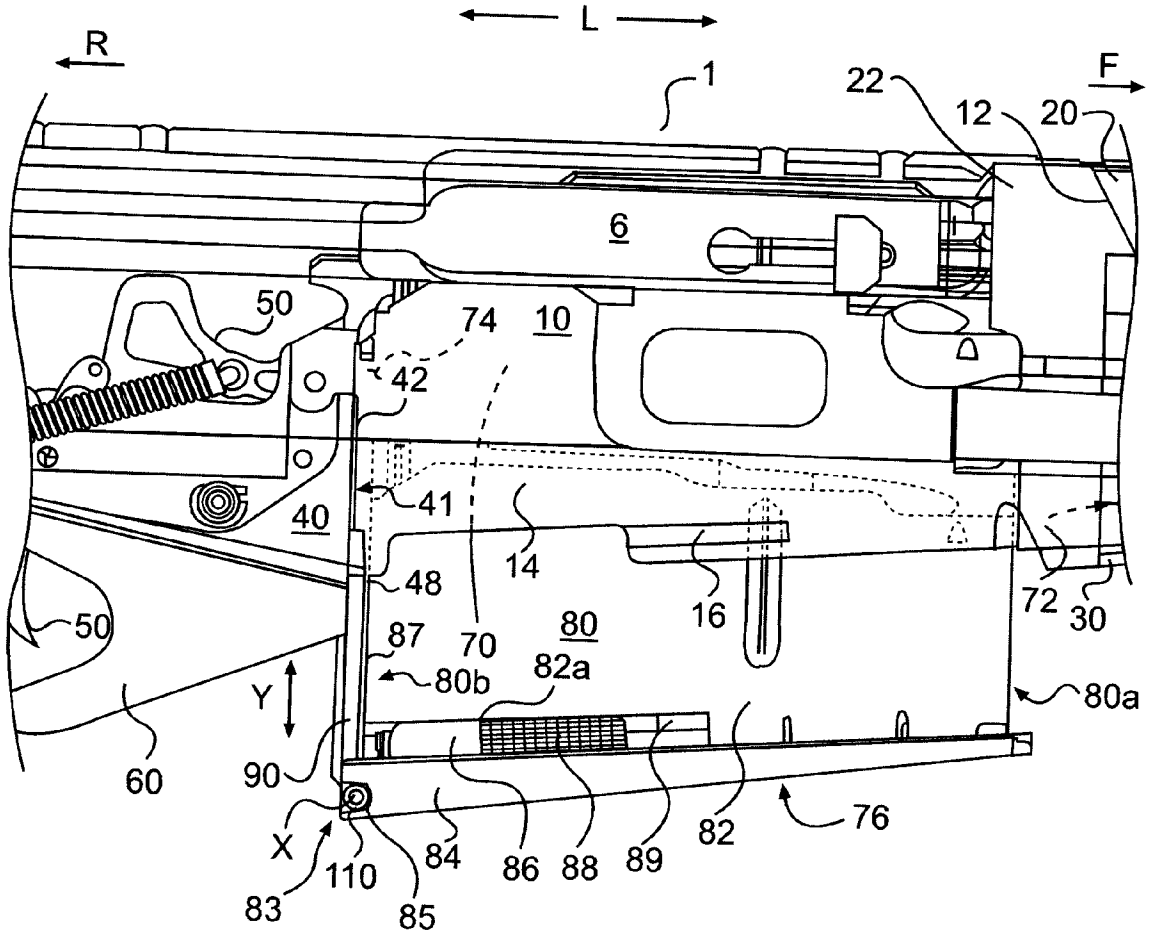
FIG. 2 is a partial side view showing the firearm with the magazine being lowered out of its operating position.
Figure 3:
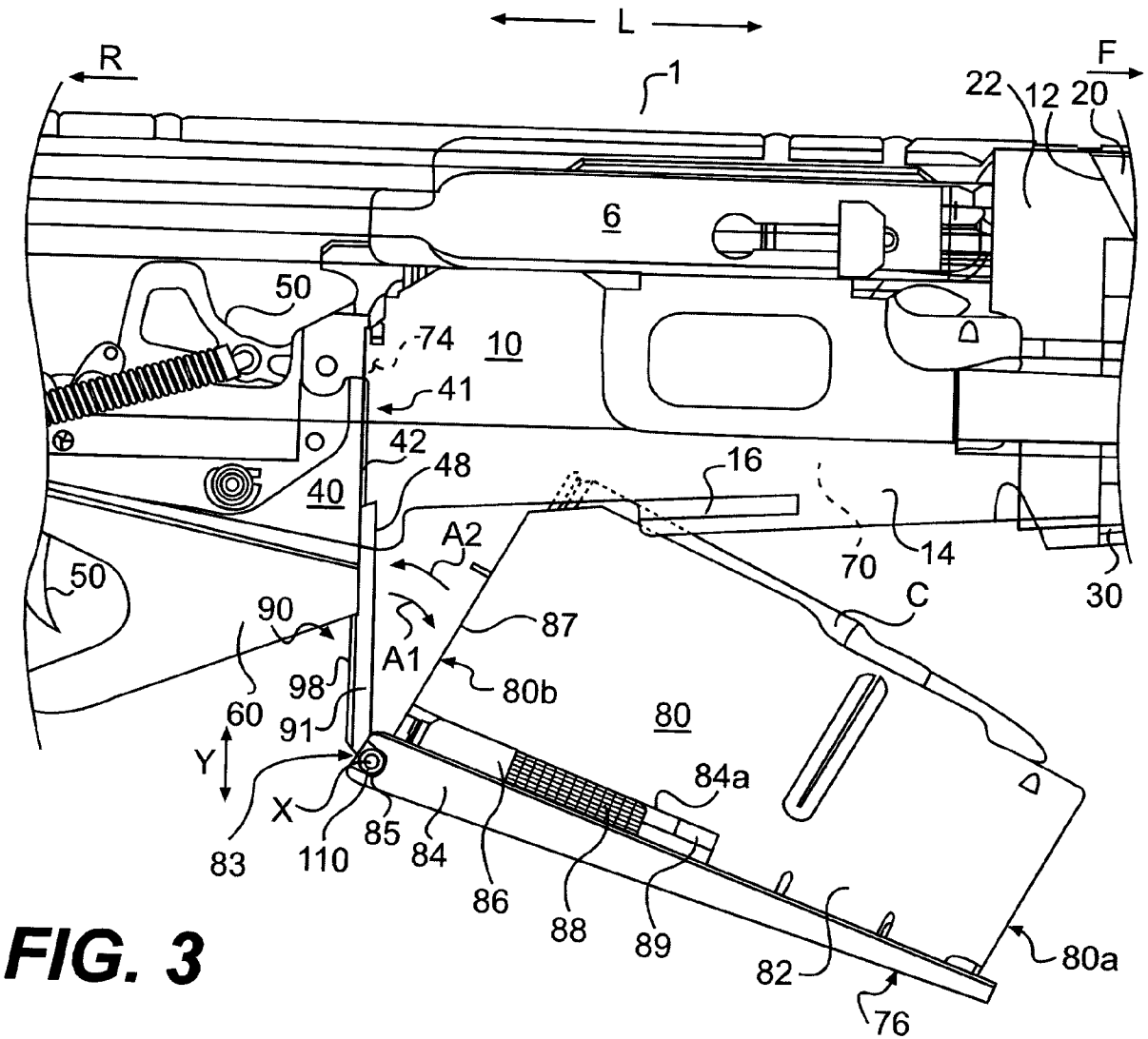
FIG. 3 is a partial side view showing the firearm with the magazine lowered and pivoted into an open position, in which ammunition can be loaded into the magazine.
Figure 4:
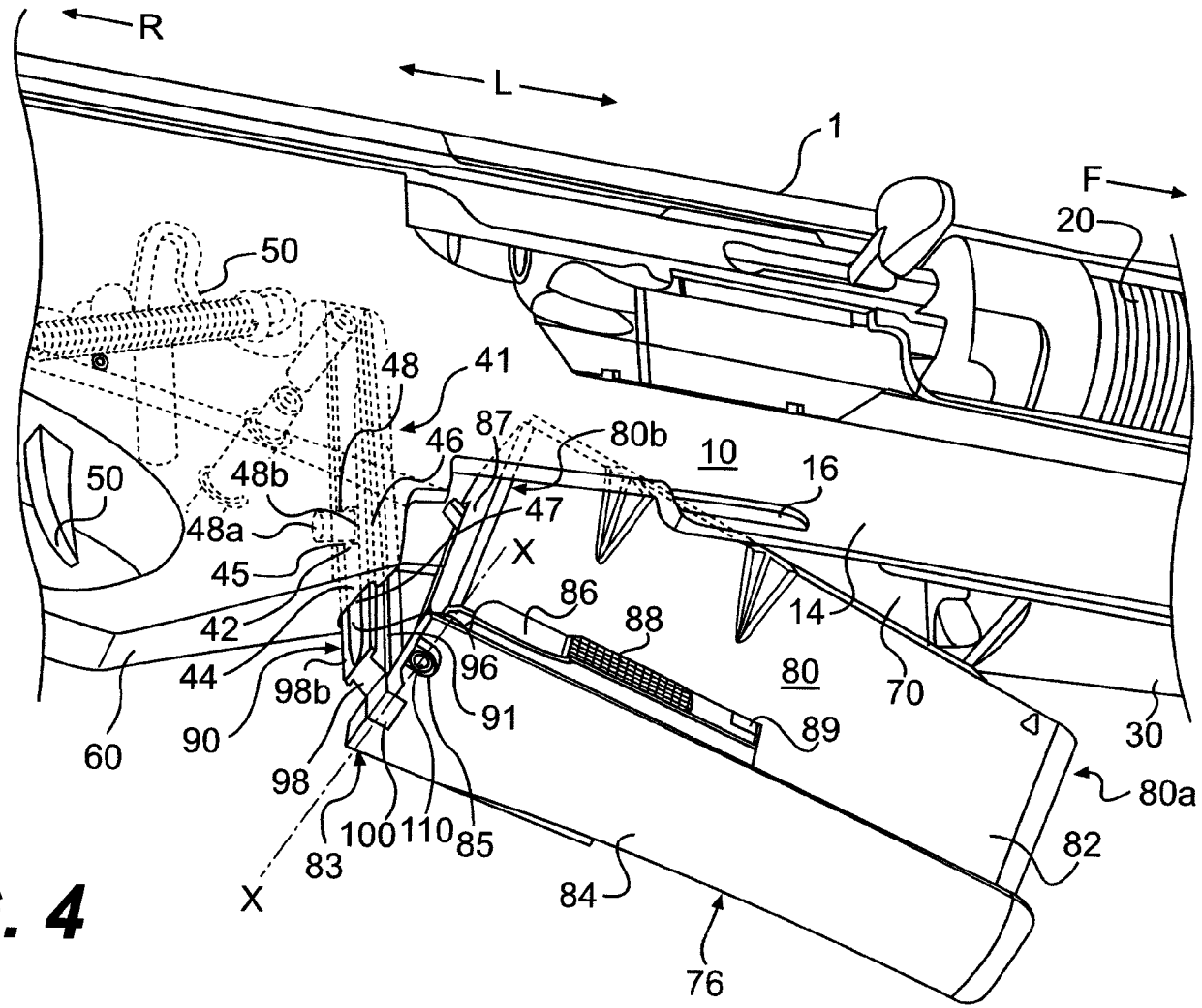
FIG. 4 is a partial perspective view showing the firearm with the magazine in the open position for loading.

As best shown in FIGS. 2-4, a magazine well 70 is defined within the receiver 10. The magazine well 70 generally is bounded at its front end 72 by the barrel 20 and the forestock 30, and is bounded at its rear end 74 by the fire control assembly 40. A loading assembly or magazine assembly 76, including a non-detachable ammunition magazine 80 pivotally attached to a sliding arm 90, is mounted to the firearm 1 so as to be moveable into and out of operative engagement within the magazine well 70.

Referencing FIGS. 1-4, the magazine 80 is secured within the magazine well 70 when the magazine 80 is in an operational position for delivering ammunition to the bolt assembly 6 of the firearm. The magazine 80 is configured such that, when secured in the magazine well 70, a front end **80*a* of the magazine 80 is received at a front end of the magazine well 70, and a rear end 80*a* of the magazine 80 is received at a rear end of the magazine well 70. The magazine 80 includes side walls 82, and a bottom 84 attached to the lower edges of the side walls 82. The lower rear corner portion 83 of the magazine 80 is pivotally attached to the sliding arm 90 via a pivot pin 110 that is inserted through a pinhole or bore 85 formed in the bottom member 84 adjacent the lower corner between the side and rear walls 82 and 87. Latch members 86 additionally protrude from the lateral sides of the magazine 80 through cut-out portions 82***a* of the side walls 82. The latch members 86 include grip portions 88 and detents or locking tabs 89 connected to the grip portions. The latch members 86 are biased outwardly, generally in a direction transverse to the longitudinal direction L of the firearm 1 under a spring force or biasing force, such that the locking tabs 89 engage locking channels or recesses 16 in the side walls 14 of the receiver 10 when the magazine 80 is raised into its operative position for supplying cartridges to the firearm, thereby securing the magazine 80 within the magazine well 70. The spring or biasing force may be applied to the latch members 86 in a known manner via coil springs (not shown), or the like, disposed in the magazine 80. According to an alternate embodiment (not shown), latch members may be provided on the side walls 14 of the receiver 10 instead of on the magazine 80, and may be configured to engage locking channels or recesses formed in the side walls 82 of the magazine.

Figure 5:
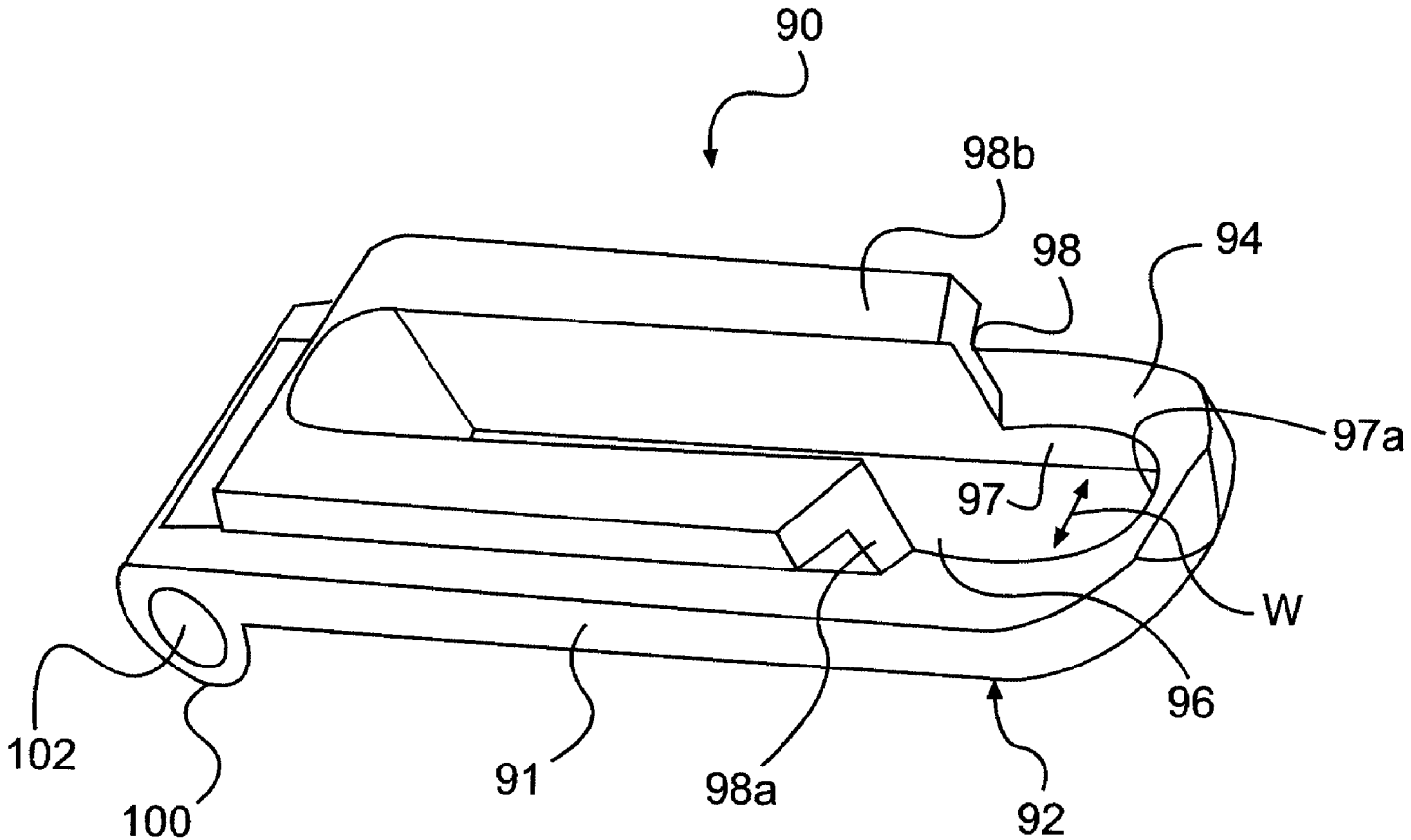
FIG. 5 is a perspective view of the sliding arm to which the magazine is pivotally attached.

Turning to FIG. 5, the sliding arm 90 is an elongate member including a main body portion 91 having substantially flat front and rear faces 92, 94, an elongated central opening 96 bounded by an internal edge 97, and a rail 98 extending outwardly from the rear face 94 around at least a portion of the opening 96. Although FIG. 5 shows the opening 96 to be oval-shaped, other shapes also are possible. Additionally, while the rail 98 is shown to extend around the perimeter of the opening 96 in a substantially U-shaped pattern, other configurations also are possible for the rail 98. The rail 98 includes a first portion 98*a* which projects transversely outward from the rear face 94 of the sliding arm 90, and a second portion 98*b* which projects transversely outward from the first portion 98*a*. As will be described in further detail below, the second portion 98*b* of the rail 98 provides a bearing surface during vertical sliding motion of the sliding arm 90. A boss 100 including a pin hole 102 may be provided at the bottom of the sliding arm 90 for receiving the pivot pin 110. As shown in FIGS. 1-4, the pin 110 may be inserted through the pinhole 85 in the bottom member 84 and through the pinhole 102 to pivotally attach the magazine 80 to the sliding arm 90.

As best shown in FIGS. 2-4, a face 41 of the trigger housing 60 that is adjacent and extends along the rear end 74 of the magazine well 70 to form a rear wall of the magazine well 70, includes a guide frame 42 in which the sliding arm 90 is slidably retained. The guide frame 42 may be an integral part of the trigger housing 60, or alternatively may be a separate part secured to the trigger housing 60 by any suitable fastening means. As best shown in FIG. 4, the guide frame 42 includes a substantially flat rear surface 44 and side surfaces 46 which define a central track 47 configured to maintain sliding engagement with the rail 98. More specifically, a portion 98*b* of the rail 98 slidably engages rear and side surfaces 44, 46, with the side surfaces 46 partially enveloping the bearing portion 98*b* of the rail 98.

Still referring to FIGS. 2-4, the sliding arm 90 is secured within the guide frame 42 by a fastening member, such as a retaining pin or bolt 48 (hereafter, "retaining pin"), which is fastened in an opening 45 extending into the trigger housing 60 through the rear surface 44 of the guide frame 42. The retaining pin has a body portion 48*a* and a head portion 48*b* extending from the body portion 48*a*. The body portion 48*a* is inserted into the opening 45, and the head portion 48*b* resides within the elongate opening 96 of the sliding arm 90. The diameter of the head portion 48*b* can be varied and may be larger than the diameter of the body portion 48*a*, but slightly smaller than or roughly equal to the width W of the elongated opening 96 to thus enable the sliding arm 90 to slide vertically (Y) within the track 47 relative to the retaining pin 48, while being guided by the rear and side surfaces 44, 46 of the guide frame 42 and the head portion 48*b* of the retaining pin 48. Downward travel of the sliding arm 90 is limited by the head portion 48*b* of the retaining pin 48, which engages the uppermost area 97*a* of the internal edge 97 of the sliding arm body portion 91 (FIGS. 4 and 5) when the sliding arm 90 is moved downwardly to its lowest position.

The process of moving the magazine 80 from the operational position shown in FIG. 1 to the loading/unloading position shown in FIGS. 3 and 4 will now be described. In order to release the magazine 80 from the magazine well 70, the user first presses the grip portions 88 of the latch members 86 inwardly (transverse to the longitudinal direction L of the firearm 1) to move the locking tabs 89 inwardly and thereby release the locking tabs 89 from engagement with the locking channels 16. Thereafter, as shown in FIG. 3, the user can move the magazine 80 downwardly, thereby substantially removing the magazine 80 from the magazine well 70. During this step, the sliding arm 90 slides vertically downward in the track 47 to allow for the downward movement of the magazine 80.

As indicated in FIG. 3, upon movement of the magazine 80 downwardly to its fully lowered, disengaged position, the magazine 80 can be pivoted in the direction A1 (clockwise in a right side view of the firearm, with the firearm aimed in the forward direction F) about the horizontal pivot axis X (transverse to the longitudinal direction L of the firearm) of the pivot pin 110. As illustrated in FIGS. 3 and 4, this pivoting motion causes the front end of the magazine 80 to rotate downwardly and towards the rear of the firearm 1, thereby exposing the interior of the magazine 80 for loading of a subsequent series of ammunition cartridges C.

In order to return the magazine 80 to the operational position shown in FIG. 1, the user can simply reverse the procedure for positioning the magazine 80 for loading. Specifically, the user will pivot the magazine 80 in the direction A2 (counter-clockwise in a right side view of the firearm, with the firearm aimed in the forward direction F) about the axis X (FIG. 3), which causes the front end of the magazine 80 to rotate upward and towards the front of the firearm 1 to a raised, ready to engage position. Thereafter, the user can push the magazine 80 upwardly, causing the sliding arm 90 to slide vertically upwardly within its track 47 into the magazine well 70 until the locking tabs 89 engage the locking slots 16 of the magazine well 70, thereby securing the magazine 80 in its engaged, operational position for supplying ammunition to the firearm during a firing operation.

Due to the magazine 80 being attached to the sliding arm 90, which is retained within the guide frame 42, the magazine 80 remains attached to the firearm 1 during operations for the loading and/or unloading of ammunition. The magazine 80 can be referred to as "non-detachable," because the magazine 80 cannot be removed from the firearm 1 for loading or unloading ammunition without disassembling the loading assembly 76. The translating and pivoting motion of the magazine 80 described herein facilitates loading and unloading maneuvers by providing easy access to the interior of the magazine 80.

The preceding description merely presents an exemplary embodiment of the invention, and the invention is not to be considered limited to what is shown in the drawings and described in the specification. It will be apparent that various changes, additions, or other modifications can be made by those skilled in the art in accordance with the invention without departing from the spirit and scope thereof.

I claim:

1. An ammunition magazine assembly for a firearm, comprising:
an arm member configured to be slidably attached within a magazine well of the firearm; and
a magazine comprising
a front end portion configured to be received within the magazine well at a front area of the magazine well, and
a rear end portion configured to be received within the magazine well at a rear area of the magazine well, wherein the magazine is pivotally connected to the arm member at the rear end portion; and
wherein the arm member comprises a rail configured to slidably engage a vertically extending track in the magazine well.

2. The ammunition magazine assembly of claim 1, wherein the magazine is pivotally connected to the arm member at a lower corner of the rear end portion.

3. The ammunition magazine assembly of claim 1, wherein the magazine is pivotable such that front end portion pivots downwardly into a loading and unloading position for loading and unloading ammunition, and pivots upwardly into an operational position for delivering ammunition to the firearm.

4. An ammunition magazine assembly for a firearm, comprising:
an arm member configured to be slidably attached within a magazine well of the firearm; and
a magazine comprising:
a front end portion configured to be received within the magazine well at a front area of the magazine well, and
a rear end portion configured to be received within the magazine well at a rear area of the magazine well, wherein the magazine is pivotally connected to the arm member at the rear end portion; and
a fastening member, wherein the arm member comprises an elongate opening through which the fastening member is receivable for retaining the arm member on the firearm.

5. The ammunition magazine assembly of claim 4, wherein the fastening member comprises a pin or a bolt.

6. An ammunition magazine assembly for a firearm, comprising:
an arm member configured to be slidably attached within a magazine well of the firearm; and
a magazine comprising:
a front end portion configured to be received within the magazine well at a front area of the magazine well, and
a rear end portion configured to be received within the magazine well at a rear area of the magazine well, wherein the magazine is pivotally connected to the arm member at the rear end portion;
wherein the arm member comprises:
a body portion having a front face, a rear face and an elongate opening; and
a rail extending outwardly from the rear face around at least a portion of the elongate opening, the rail being configured to slidably engage a track in the magazine well.

7. The ammunition magazine assembly of claim 6, wherein the rear wall of the magazine well is formed by a trigger housing of the firearm.

8. The ammunition magazine assembly of claim 6, comprising a retaining member receivable within the elongate opening for retaining the arm member on the firearm.

9. The ammunition magazine assembly of claim 7, wherein the retaining member comprises a pin or a bolt.

10. The ammunition magazine assembly of claim 6, wherein the rail is substantially U-shaped.

11. The ammunition magazine assembly of claim 6, wherein the rail comprises:
a first portion that projects transversely from the rear face; and
a second portion that projects from the first portion for slidably engaging the track.

12. An ammunition magazine assembly for a firearm, comprising:
an arm member configured to be slidably attached within a magazine well of the firearm; and
a magazine comprising:
a front end portion configured to be received within the magazine well at a front area of the magazine well, and
a rear end portion configured to be received within the magazine well at a rear area of the magazine well, wherein the magazine is pivotally connected to the arm member at the rear end portion; and
at least one latch member disposed on a lateral side of the magazine and configured to secure the magazine in the magazine well, the at least one latch member comprising a grip portion and a detent connected to the grip portion.

13. The ammunition magazine assembly of claim 12, wherein:
the latch member is biased outwardly under a biasing force for placing the detent into engagement with a side wall of a receiver of the firearm; and
the latch member is inwardly movable for releasing the detent from engagement with the side wall of the receiver by depressing of the grip portion.

14. A firearm comprising:
a receiver:
an ammunition magazine receivable in the receiver, the magazine comprising:
a front end portion configured to be received within the magazine well at a front area of the magazine well, and
a rear end portion configured to be received within the magazine well at a rear area of the magazine well, wherein the magazine is pivotally connected to the firearm at the rear end portion such that the front end portion is pivotable upwardly and downwardly; and
an arm member slidably mounted on the firearm, wherein the magazine is pivotally connected to the arm member at the rear end portion; and wherein:
the arm member is vertically slidable into an uppermost position in which the magazine is upwardly pivotable into an operational position, secured within the magazine well; and
the arm member is vertically slidable into a lowermost position in which the magazine is downwardly pivotable into a loading and unloading position for loading and unloading ammunition.

15. The firearm of claim 14, wherein the arm member comprises an elongate opening, and the firearm further comprises a fastening member extending through the elongate opening and into a rear wall of the magazine well, thereby retaining the arm member on the firearm.

16. The firearm of claim 15, wherein the rear wall of the magazine well is formed by a trigger housing of the firearm.

17. The firearm of claim 15, wherein the arm member is vertically slidable relative to the fastening member, and the fastening member limits downward travel of the arm member such that the magazine remains connected to the firearm in the loading and unloading position.

18. The firearm of claim 15, wherein the fastening member comprises a bolt or a pin.

19. The firearm of claim 14, comprising a track on a rear wall of the magazine well, wherein the arm member slidably engages the track.

20. The firearm of claim 19, wherein the arm member comprises:

a body portion having a front face and a rear face; and a rail extending outwardly from the rear face, wherein the rail slidably engages the track.

21. The firearm of claim 20, wherein the rail comprises:

a first portion that projects transversely outward from the rear face; and a second portion that projects transversely outward from the first portion in sliding engagement with the track.

22. The firearm of claim 20, wherein:

the arm member comprises an elongate opening in the body portion;

the firearm comprises a fastening member extending through the elongate opening and into the rear wall of the magazine well;

the arm member is vertically slidable relative to the fastening member; and the fastening member limits downward travel of the arm member such that the magazine remains connected to the firearm in its loading and unloading position.

23. The firearm of claim 22, wherein the rail is substantially U-shaped.

24. The firearm of claim 14, wherein:

the receiver comprises at least one locking recess; and the magazine comprises at least one latch member disposed on a lateral side of the magazine, the at least one latch member comprising a grip portion and a detent connected to the grip portion; and the detent is configured to engage the at least one locking recess to secure the magazine in the magazine well when the magazine is in its operational position.

25. The firearm of claim 24, wherein the at least one latch member is biased outwardly under a biasing force for placing the detent into engagement with the at least one locking recess; and the at least one latch member is inwardly movable for releasing the detent from engagement with the at least one locking recess by depressing of the grip portion.

* * * * *